United States Patent [19]

Grass et al.

[11] 4,347,776

[45] Sep. 7, 1982

[54] O-RING LIGATURE

[76] Inventors: Kenneth G. Grass; Tommy R. Stout, both of Broken Arrow, Okla.

[21] Appl. No.: 259,666

[22] Filed: May 1, 1981

[51] Int. Cl.[3] ..... G10D 9/02

[52] U.S. Cl. ..... 84/383 R

[58] Field of Search ..... 84/383 R

[56] References Cited

U.S. PATENT DOCUMENTS

| | | | |
|---|---|---|---|
| 1,496,535 | 6/1924 | Hammann | 84/383 R |
| 2,791,929 | 5/1957 | Bonade | 84/383 R |
| 4,056,997 | 11/1977 | Rovner | 84/383 R |
| 4,258,604 | 3/1981 | Giokas | 84/383 R |
| 4,275,636 | 6/1981 | Van Doren | 84/383 R |

*Primary Examiner*—Lawrence R. Franklin

*Attorney, Agent, or Firm*—Head, Johnson & Stevenson

[57] ABSTRACT

A ligature for retaining a reed on the mouthpiece of a woodwind instrument such as a clarinet or saxophone comprising a pair of rubber O-rings adapted to fit over the reed and mouthpiece applying sufficient compressive force to hold said reed in place. The O-rings are held at a predetermined fixed distance apart by the use of a stiff flat strip of braided nylon looped about each O-ring such as to allow for twisting and untwisting of the O-rings.

5 Claims, 3 Drawing Figures

O-RING LIGATURE

BACKGROUND OF THE INVENTION

1. Field of the Invention

The present invention relates to a device for holding a reed on a mouthpiece of a musical instrument, commonly referred to as a ligature. More specifically, it deals with a ligature involving a pair of elastomeric O-rings held at a predetermined distance apart.

2. Description of the Prior Art

The contemporary mouthpiece of conventional clarinets and saxophones usually consists of a thin flat reed attached to a hard rubber mouthpiece by a ligature such that the reed is free to vibrate and generate sound when the musician plays the instrument. Various ligatures have historically been employed to hold the reed to the mouthpiece with varying degrees of success. One of the earliest methods of attaching the reed was by use of thread or string repeatedly wrapped around the reed and mouthpiece. Because of the time consuming nature of the hand winding of reeds which must be redone frequently and because of the need for quick and easy adjustment and replacement of reeds, the use of various types of metal bands with thumb screw tension adjustments have virtually replaced the string wound ligature. However, literature recognizes that the resilience of a string provides sufficient flexibility to the reed to produce a superior quality tone, timbre and sound relative to a rigid metal clamping type ligature.

Various alternatives through the years have been suggested and proposed. For example, in an early German Pat. No. 384,940, the use of an elastic band with a metal clip for applying tension was proposed but has not proven successful. In U.S. Pat. No. 2,292,584 a frusto-conical sleeve ligature lined with felt was suggested as a substitute for a metal ligature. More recently U.S. Pat. No. 3,523,481 discloses the use of a resilient rubber inlay at the reed mounting surface in combination with a rigid sleeve ligature while U.S. Pat. No. 4,185,535 reverts back to the use of a wrapped string which is mounted in a metal bracket ligature for applying tension by stretching or tightening the string. This latter patent further recognizes that the spacing between successive wrappings of the string influences the quality of the music being produced. Other compromises between ease of use and quality of sound have been suggested, such as a quick release string steel ligature of British Pat. No. 1,530,309. However, none of these ligatures can be considered as having achieved the best of both worlds.

SUMMARY OF THE INVENTION

In view of the fact that previously known ligatures have been unable to simultaneously optimize the desirable qualities of the musical sound being produced along with simplicity of operation and ease of assembly and disassembly of the ligature, we have discovered an improved ligature device for holding a reed to a woodwind musical instrument mouthpiece comprising:

(a) a pair of elastomeric rings adapted to sequentially fit over the reed and mouthpiece applying sufficient compressive force to hold the reed in place; and (b) a means for holding the elastomeric bands at a predetermined fixed distance apart from each other.

The present invention provides in one embodiment that the elastomeric rings or bands are rubber O-rings and that the means for holding the O-rings is a strip of rigid plastic capable of allowing the O-rings to readily twist and untwist. The invention further provides for the size of the O-rings and the fixed distance they are held apart to be selected according to which particular contemporary commercial mouthpiece is being employed.

It is a primary object of the present invention that an inexpensive ligature be provided that is easily and readily disassembled and reassembled for cleaning, replacing the reed, adjustment, and the like while simultaneously preserving the tone, timbre and other desirable characteristics of the sound. It is a further object that the ligature be designed to control the compressive tension and the points of application of this tension on the reed such as to improve the quality and ability to select the desired sound and tongue consistency. Fulfillment of these objects will be obvious upon reading of the complete specifications and claims taken in conjunction with the attached drawing.

DESCRIPTION OF THE PREFERRED EMBODIMENTS

Figure 1:
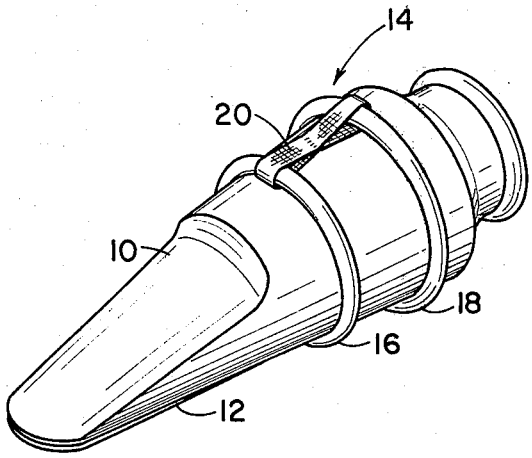
FIG. 1 is a perspective view illustrating an O-ring ligature according to the present invention in place on the mouthpiece of a saxophone.

The mouthpiece for a woodwind instrument such as the clarinet and saxophone is conventionally carved from wood, or molded of plastic or hard rubber. Although they vary somewhat in size, external appearance, design and shape, they characteristically have a tapered end to be placed in the musicians' mouth and a concentric opening at the other end to couple with the musical instrument. A reed consisting of a thin flat blade, usually made of cane or the like, free to vibrate and tapered towards the musician, is positioned on one side of the mouthpiece over an appropriate opening and held there by a ligature. The improved ligature of the present invention and its relationship to the basic mouthpiece and reed can perhaps be best explained and understood by referring to the drawing.

Figure 2:
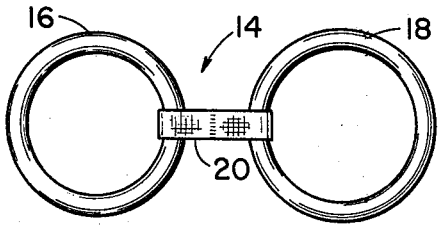
FIG. 2 is a top view of the O-ring ligature of FIG. 1 removed from the mouthpiece and spread out flat.
Figure 3:
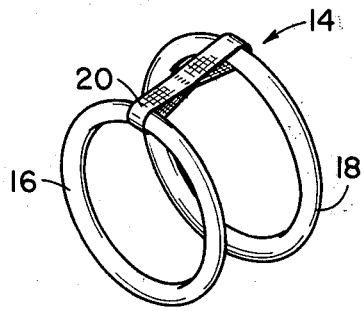
FIG. 3 is a perspective view of the O-ring ligature of FIG. 2 removed from the mouthpiece.

FIG. 1 illustrates a perspective view of an alto saxophone mouthpiece 10 with a cane reed 12 positioned on the underside. A ligature according to the present invention generally referred to by numeral 14, is positioned concentrically about the mouthpiece and reed. Tension required to hold the reed firmly to the mouthpiece is supplied by O-rings 16 and 18. The O-rings 16 and 18 are positioned about the mouthpiece at a pedetermined fixed distance apart by virtue of a stiff flat strap 20 which has been folded back on itself about both O-rings and stitch fastened between the O-rings thus forming a figure eight loop. Sufficient curvature of strap 20 is provided about each O-ring 16 and 18 to allow for twisting and untwisting of the elastomeric O-ring during assembly and disassembly. Thus, as illustrated in FIGS. 2 and 3, the O-rings are free to swivel within the strap 20 from a flat configuration of FIG. 2 to the functional configuration of FIG. 3.

In use, the ligature is held in one hand with the mouthpiece and reed in the other hand. The tip of the mouthpiece and reed are inserted coaxially through the opening of the larger of the two O-rings 18 and then through the smaller O-ring 16 with the strap 20 being aligned generally on the opposite side of the mouthpiece relative to the reed. Since the strap allows for twist the O-rings can easily be slipped up the gently expanding slope of the mouthpiece ever increasing the tension of the reed. A gentle repeated lift on each O-ring will serve to remove any twist and simultaneously align the rings at the desired predetermined fixed spacing. Similarly, the tension on the reed can be easily adjusted by slipping the ligature up and down the inclined slope of the mouthpiece.

The tension to be applied to the reed depends on the selection of elastomeric material being employed, the amount of elastomeric material being used or more specifically the thickness of the band or ring, the relative diameter of the unstretched elastomer band or O-ring relative to the diameter of the mouthpiece and how far one expands the elastomer band or O-ring when positioning the ligature on the slope of the mouthpiece. It is this latter feature that can be advantageously used to fine tune and adjust the ligature for a desired sound even during the playing of the instrument. In practice we have found that the conventional stiff black neoprene O-ring having a thickness of the order of 2–5 mm (preferably about 3 mm) and having an internal diameter slightly less than the external diameter of the mouthpiece will create extraordinary compressive force on the reed yet hold the reed in an inherently resilient environment superior to previously used ligatures.

The predetermined spacing between the O-rings can be used to control the relative positions of compressive contact on the reed and can be selected such as to influence the tone, timber, clarity and response of the woodwind instrument. The TABLE below sets forth O-ring sizes and fixed spacing for a set of commercially available contemporary mouthpieces. Each entry in the TABLE represents a particular choice of parameters which are considered excellent for that particular mouthpiece. All O-rings were of the commercially available type commonly sold as stiff black neoprene rubber O-ring of approximately 3 mm thickness manufactured by E. I. duPont.

The Front O-ring and Back O-ring of Table refer sequentially to the smaller O-ring and larger O-ring of the drawing, respectively. The length of the Braided Strap is the dimension of the so-called Horse Hair Braid (a stiff flat nylon braided material about ¼ inches wide) prior to being assembled around the O-rings, i.e., folded back on itself and stitched.

TABLE

| Instrument (Tradename of Hard Rubber Mouthpiece) | Front O-ring Diameter | Back O-ring Diameter | Length of Braided Strap |
|---|---|---|---|
| Soprano Sax | ¾" | 13/16" | 1¾" |
| Tenor Sax (Runyon) | 13/16" | ⅞" | 2 |
| Alto Sax (Selmer HS*, Vandoren B45) | 15/16" | 1" | 2" |
| Tenor Sax (Vandoren 77,88,99) | 15/16" | 1" | 2¼" |
| Tenor Sax (Selmer CS80) | 1" | 1 1/64" | 2¼" |
| $E^b$ Bari Sax (Bilhurt 5*, Selmer Bundy[3]) | 1" | 1 1/64" | 2¼" |

TABLE-continued

| Instrument (Tradename of Hard Rubber Mouthpiece) | Front O-ring Diameter | Back O-ring Diameter | Length of Braided Strap |
|---|---|---|---|
| Soprano Clarinet (Selmer HS*, Vandoren B45) | 15/16" | 1" | 2" |
| $E^b$ & $B^b$ Contra Clarinet (Selmer C*) | 1 13/16" | 1 15/16" | 2¼" |
| $B^b$ Bass Clarinet | 1⅛" | 1 3/16" | 2¼" |

The means for holding the O-rings at a predetermined distance apart from each other in general can be any such device known to the art that would link the two O-rings together and would include but not be limited to a rigid strap, a flexible chain, a piece of string, a molded piece of plastic, a strip of Velcro ® and the like. Preferably the rings should be free to twist within the holding device. The illustrated strap made of a stiff rigid open weave nylon braid folded back on itself and then stitched, glued, riveted or comparably fastened is preferred. A Velcro ® strip at the region of overlap would allow for adjustment of the fixed distance. The composition of the elastomeric band can be selected generally from any of the well known synthetic or natural rubber compositions and preferably is selected and sized such as to involve considerable compressive force sufficient to retain the reed. Although conventional neoprene rubber O-rings are particularly suitable, other elastomer compositions and other elastomeric bands with varying cross-sectional geometries are contemplated as being equivalent for purposes of this invention. The use of a pair of O-rings or elastomeric bands is preferable but multiple bands or O-rings are also considered to be within the scope of this disclosure and may be of particular utility in mouthpieces which are intended to supress particular overtones conventional and harmonics.

While the invention has been described with a certain degree of particularity, it is manifest that many changes may be made within the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

We claim:

1. A ligature device for holding a reed to a woodwind musical instrument mouthpiece comprising:

(a) a pair of elastomeric rings adapted to sequentially fit over the reed and mouthpiece applying sufficient compressive force to hold said reed in place; and (b) a means for holding said elastomeric rings at a predetermined fixed distance apart from each other.

2. A ligature device of claim 1 wherein said pair of elastomeric rings are rubber O-rings.

3. A ligature device of claim 2 wherein said means for holding said O-rings is a strip of rigid plastic capable of allowing said O-rings to readily twist and untwist.

4. A ligature of claim 2 or 3 wherein the sizes of said pair of O-rings and said fixed distance is selected according to the following table:

| Instrument (Tradename of Hard Rubber Mouthpiece) | Front O-Ring Diameter | Back O-Ring Diameter | Length of of Braided Strap |
|---|---|---|---|
| Soprano Sax | ¾" | 13/16" | 1¾" |
| Tenor Sax (Runyon) | 13/16" | ⅞" | 2" |
| Alto Sax (Selmer HS*, Vandoren B45) | 15/16" | 1" | 2" |
| Tenor Sax (Vandoren 77,88,99) | 15/16" | 1" | 2¼" |
| Tenor Sax (Selmer CS80) | 1" | 1 1/64" | 2¼" |
| $E^b$ Bari Sax (Bilhurt 5*, Selmer Bundy[3]) | 1" | 1 1/64" | 2¼" |
| Soprano Clarinet (Selmer HS*, (Vandoren B45) | 15/16" | 1" | 2" |
| $E^b$ & $B^b$ Contra Clarinet (Selmer C*) | 1 13/16" | 1 15/16" | 2¼" |
| $B^b$ Bass Clarinet | 1⅛" | 1 3/16" | 2¼" |

5. A method for holding a reed to a woodwind musical instrument mouthpiece comprising the steps of:

(a) sequentially fitting a pair of elastomeric O-rings over the reed and mouthpiece, said O-rings applying sufficient compressive force to hold said reed in place; and (b) selecting and positioning said pair of O-rings at a predetermined fixed distance apart from each other according to the following table:

| Instrument (Tradename of Hard Rubber Mouthpiece) | Front O-Ring Diameter | Back O-Ring Diameter | Fixed Distance |
|---|---|---|---|
| Soprano Sax | ¾" | 13/16" | ⅞" |
| Tenor Sax (Runyon) | 13/16" | ⅞" | 1" |
| Alto Sax (Selmer HS* Vandoren 77,88 99) | 15/16" | 1" | 1" |
| Tenor Sax (Vandoren 77,88,99) | 15/16" | 1" | 1⅛" |
| Tenor Sax (Selmer CS80) | 1" | 1 1/64" | 1⅛" |
| E♭ Bari Sax (Bilhurt 5*, Selmer Bundy[3]) | 1" | 1 1/64 | 1⅛" |
| Soprano Clarinet (Selmer HS*, Vandoren B45) | 15/16" | 1" | 1" |
| E♭ & B♭ Contra ⅛" Clarinet (Selmer C*) | 1 13/16" | 1 15/16" | 1" |
| B♭ Bass Clarinet | 1⅛" | 1 3/16" | 1⅛" |

* * * * *